US006401293B1

(12) United States Patent
Young et al.

(10) Patent No.: US 6,401,293 B1
(45) Date of Patent: Jun. 11, 2002

(54) BEARER WIPE HOLDER FOR A PRINTING PRESS

(75) Inventors: Michael Scott Young, Eliot, ME (US); Raymond Alphonse Hebert, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/589,026

(22) Filed: Jun. 7, 2000

(51) Int. Cl.[7] ..... B41F 41/00
(52) U.S. Cl. ..... 15/256.51; 101/425
(58) Field of Search ..... 15/256.5, 256.51; 101/425

(56) References Cited

U.S. PATENT DOCUMENTS 700,133 A * 5/1902 Connelly
3,078,825 A * 2/1963 Munton et al.
3,986,453 A * 10/1976 Boose
4,434,552 A * 3/1984 Linzberger
4,893,562 A * 1/1990 Robertson

* cited by examiner

*Primary Examiner*—Terrence R. Till
(74) *Attorney, Agent, or Firm*—Davidson, Davidson Kappel, LLC

(57) ABSTRACT

A bearer wipe holder includes a base and a fastener selectively movable with respect to the base, a wipe fitting between the base and the fastener, the fastener contacting the base through the wipe at least separate two locations when the wipe is between the base and the fastener. Also disclosed is a bearer wipe including a body having at least a first hole for receiving a pin of a wipe holder and a second hole or slot for receiving one of a second pin and a bolt of a bearer holder, as well as a method for wiping a bearer of a printing press comprising the steps of placing a wipe against a base of a bearer holder, placing a fastener over the wipe so that the fastener contacts the base at least two separate locations so as to firmly hold the wipe between the base and the fastener, and contacting the bearer with the wipe.

13 Claims, 3 Drawing Sheets

BEARER WIPE HOLDER FOR A PRINTING PRESS

BACKGROUND OF THE INVENTION

1. Field of the Invention

The present invention relates generally to printing presses and more particularly to wipe holders for wipes for printing press bearers.

2. Background Information

Rotary printing presses have rotating cylinders for printing sheets or a web of material, such as paper.

When two cylinders next to each other run in a certain relationship to one another, for example 1:1, bearers often are provided at the end of the cylinders. For example, on an offset lithographic printing press, a plate cylinder bearer at the end of a plate cylinder can be in rolling contact with a blanket cylinder bearer at the end of the blanket cylinder. The bearers help ensure smooth rolling contact between the two cylinders.

The rolling surfaces of the bearers however often become fouled or contaminated, for example by printing inks and paper waste. Thus it has been known to provide wipes to wipe the rolling surfaces of the bearers. These wipes typically have been held by a wipe holder similar to a clip. The holder often provides an insufficient hold on the wipe and allows the wipe to lose contact with the bearer. The wipe can be knocked out of place or skew easily. The pressure applied to the bearer also is dependent upon the wipe material stiffness. In addition, a tool such as a screw driver is required to release the clip.

BRIEF SUMMARY OF THE INVENTION

An object of the present invention is to provide a bearer holder capable of holding the wipe firmly in place. Another alternate or additional object of the present invention is to provide a bearer wipe holder which does not permit skewing of the wipe. Yet another alternate or additional object of the present invention is to provide a holder which can be adjusted to compensate for different wipe material stiffness. Another alternate or additional object of the present invention is to eliminate the need for a tool to change wipes.

The present invention thus provides a bearer wipe holder comprising a base and a fastener selectively removable from the base, a wipe fitting between the base and the fastener, the fastener contacting the base through the wipe at least separate two locations when the wipe is between the base and the fastener.

By providing contact between the base and the fastener through the wipe at at least two separate locations, the wipe can be held firmly between the fastener and the base and be prevented from skewing.

Preferably, the base and the fastener are connected by at least two pins and a bolt. The pins preferably are fixed to at least one of the fastener and the base, and interact with holes in the other of the fastener and the base. The bolt preferably is a rotatably connected to the base, and is spring-loaded toward the base by a spring in the base operating on a knob at the base end of the bolt. The fastener preferably has an aperture through which a part of the bolt head can fit when the bolt is in a first rotational position, so that the fastener can permit replacement of the wipe. In a second rotational position, the bolt head tightly holds the wipe between the fastener and the base through contact of the wipe with a contact surface of the bolt head. The bolt can be rotated by hand by pulling against the spring force. Preferably a quarter turn of the bolt can provide for the fastener to be in a release or a fastening position.

The present invention also provides a bearer wipe comprising a felt body having at least a first hole for receiving a pin of a wipe holder and a second hole or slot for receiving one of a second pin and a bolt of a bearer holder. Preferably, the bearer wipe further includes a third hole or slot for receiving the other one of the second pin and the bolt.

The wipe preferably is made of felt and may be for example 3/16 ths of an inch thick.

The present invention also provides a method for wiping a bearer of a printing press comprising the steps of:

placing a wipe against a base of a bearer holder; and placing a fastener over the wipe so that the fastener contacts the base through the wipe at at least two separate locations so as to firmly hold the wipe between the base and the fastener.

Preferably, the method further includes using a rotatable bolt to tighten the fastener with respect to the base and the wipe.

In a preferred embodiment, the method includes the steps of placing a wipe over a base of a bearer holder having two holes, aligning two wipe holes with the two holes, placing a wipe fastener with two pins over the wipe so that the two pins fit through the two wipe holes into the two holes. The fastener may then be fastened to hold the wipe tightly, preferably by a rotatable bolt.

The base of the wipe holder preferably is rotatably supported through a pin to permit for an adjustment of the contact angle of the wipe and the bearer. In this way, pressure against the bearer can be changed to compensate for different wipe stiffnesses.

BRIEF DESCRIPTION OF THE DRAWINGS

A preferred embodiment of the present invention is described below by reference to the following drawings, in which.

DETAILED DESCRIPTION

Figure 1:
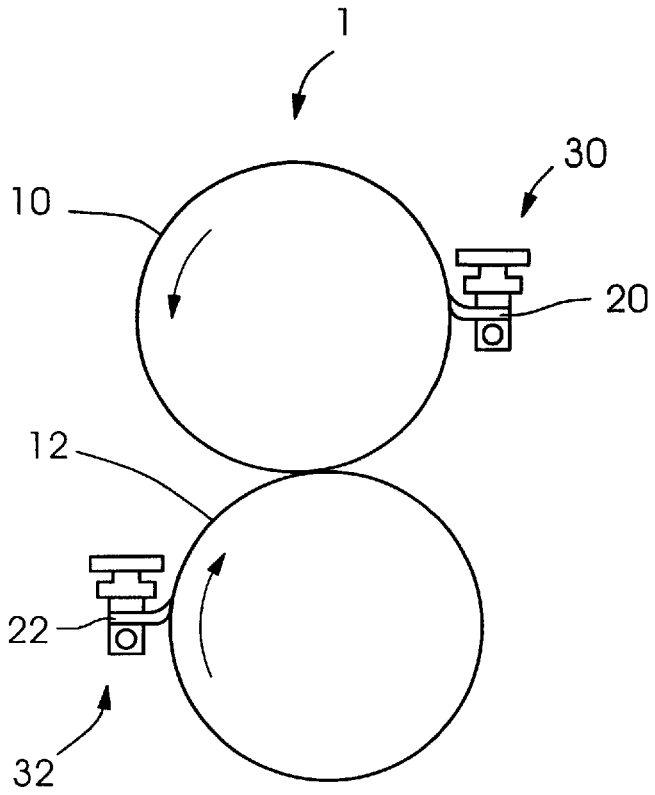
FIG. 1 shows a schematized side view of a printing press with two bearer wipe holders of the present invention with wipes contacting the bearers of the press.

FIG. 1 shows part of a printing press 1 having a plate cylinder bearer 10 and a blanket cylinder bearer 12, with a first bearer wipe 20 being held by a first bearer wipe holder 30 and a second bearer wipe 22 being held by a second bearer holder 32.

Figure 2:
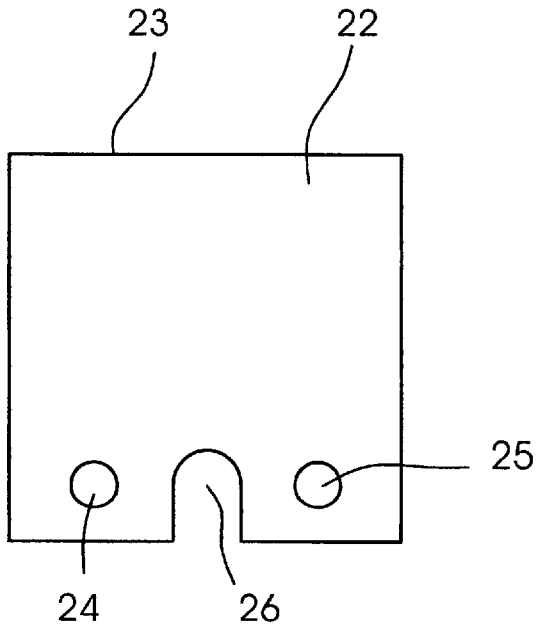
FIG. 2 shows a top view of a wipe according to the present invention.

FIG. 2 shows a top view of wipe 22 having a contact surface 23 for contacting bearer 10. Wipe 22 preferably is made of felt. Wipe 22 has two pin holes 24, 25 and a slot 26, to enable wipe 22 of the present invention to be held firmly by bearer wipe holder 32.

Figure 3:
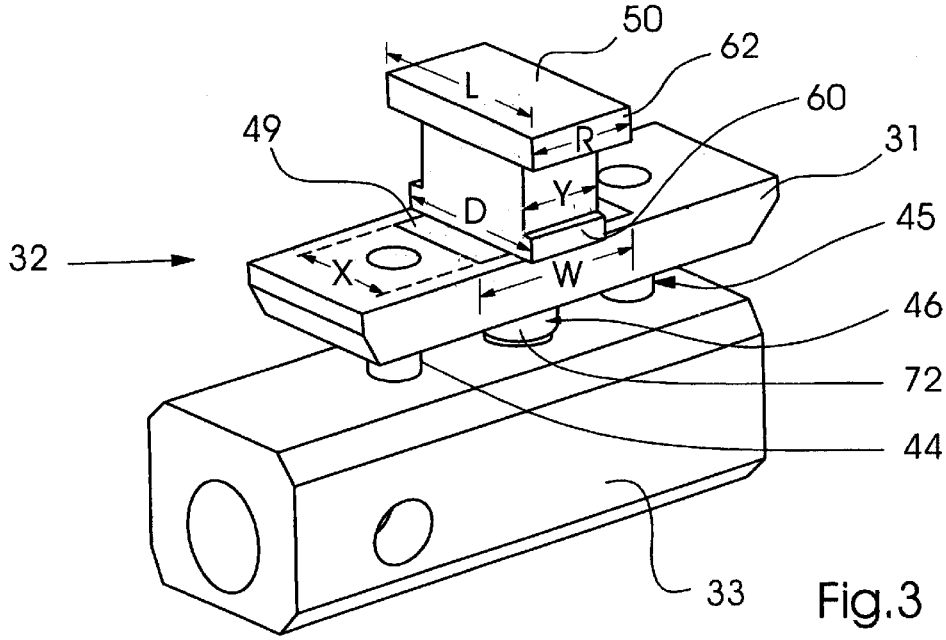
FIG. 3 shows perspective view of the bearer wipe holder of the present invention.
Figure 7:
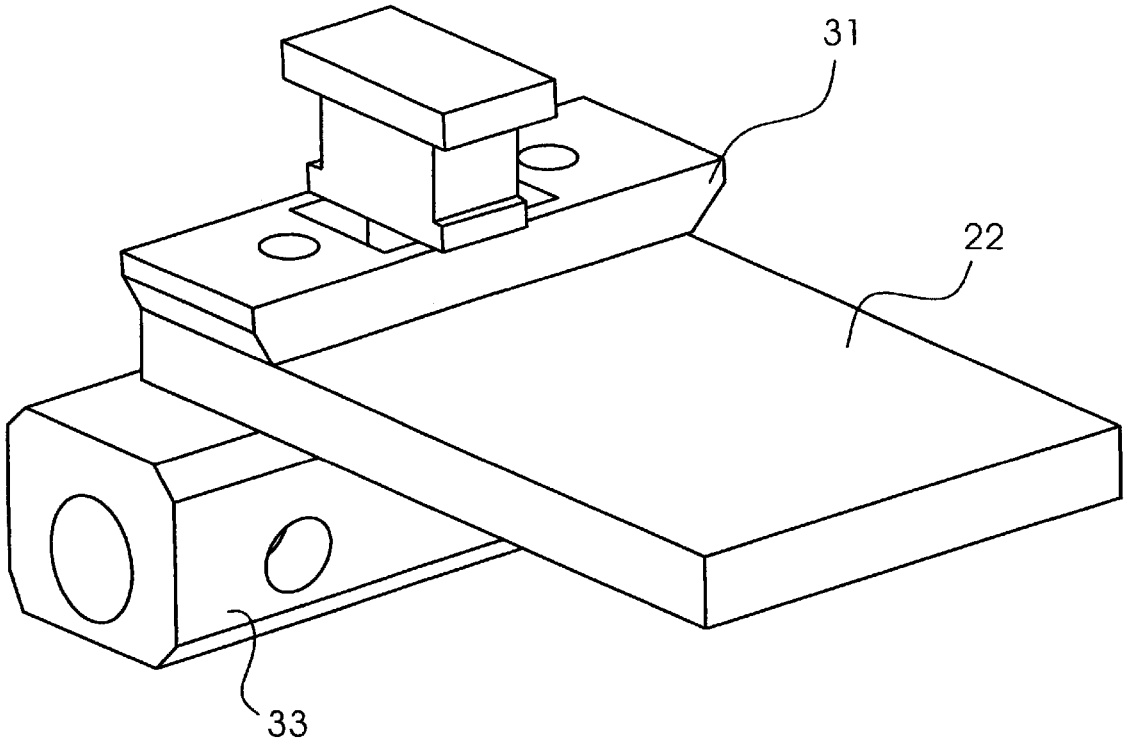

Wipe 22 is able to be fastened to wipe holder 32, which is shown in more detail in FIG. 3. Wipe holder 32 in FIG. 3 is shown in a closed position without wipe 22 for clarity purposes. Wipe 22 fits between a fastener 31 and a holder base 33, as shown in FIG. 7. As shown in FIG. 3, fastener 31 has two pins 44, 45, which fit into holes 24, 25 (FIG. 2), respectively, of wipe 22.

Figure 4:
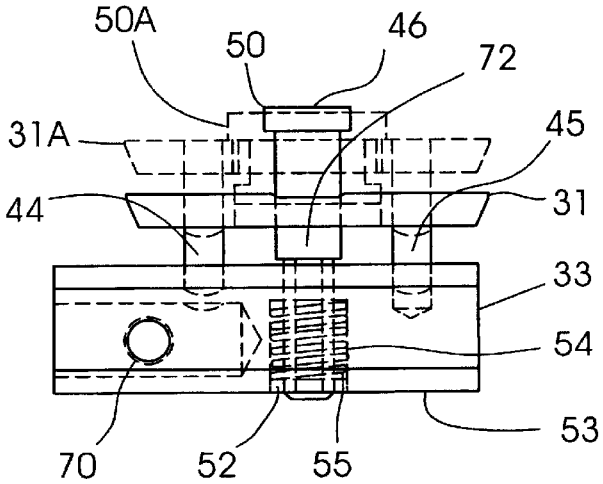
FIG. 4 shows a side view of the bearer wipe holder of the present invention, showing the fastener in both positions.

Slot 26 of wipe 22 (FIG. 2) fits around a bolt 46 so that bolt 46 contacts the base and the fastener through wipe 20 and bolt 46 is surrounded on three sides by wipe 20. Bolt 46 includes a head section 50, and as shown in FIG. 4, a flanged section 52 at the end of bolt 46 opposite head 50. Flanged section 52 is limited in one direction so that it cannot extend fully beyond a surface 53 of base 33. However flanged section 52 can move in the other direction (upward in FIG. 4) through a cut-out 54 in base 33. In cut-out 54 is a spring 55 which acts to push flanged section 52 and thus bolt 46 toward surface 53 (downward in FIG. 4). Thus head 50 is forced in the direction of base 33. Head 50 however may be pulled manually against the action of spring 55 so that head 50 can move away from base 33 and may be rotated.

As shown in FIG. 3, fastener 31 has a aperture 49, through which a first end 60 of head 50 can fit when oriented 90 degrees from the position shown in FIG. 3. Aperture 49 has dimensions X and W. First end 60 has dimensions D and Y, and second end 62 has dimension L and R. The following relationships apply:

D>X;

D<W; and

X>Y.

Thus first end 60 can pass through aperture 49 in an unlocking orientation of head 50 which is 90 degrees from that shown in FIG. 3. Fastener 31 preferably is not removable from the holder, as preferably L>W and/or R>X so that second end 62 cannot pass through aperture 49.

Once aperture 49 of fastener 31 passes first end 60, pins 44, 45 are lifted beyond base 33 so that a wipe 20 (FIG. 2) can be inserted into wipe holder 30. In this position, fastener 31 is in position 31A, as shown in FIG. 4, and head 50 in position 50A. Thus wipes 22 can be exchanged easily without the need for a separate tool. To fasten the wipe again, fastener 31 is moved over end 60 of head 50, and bolt 46 is rotated 90 degrees to attain the position shown in FIG. 3 again and fasten fastener 31 against wipe 22. Pins 44, 45 thus fit into holes 24, 25, respectively, of wipe 22 (FIG. 2), so that wipe 22 is prevented from skewing or releasing. The spring action of spring 55 also operates so that second end 62 pulls fastener 31 against wipe 22, thereby increasing the hold of holder 30 on wipe 22.

As shown in FIG. 4, base 33 can be held in a selectively rotatable fashion by a pin 70 to a frame. Thus an angle of contact between the wipe 22 and bearer 12 (FIG. 1) can be adjusted to compensate for different wipe stiffnesses.

Figure 5:
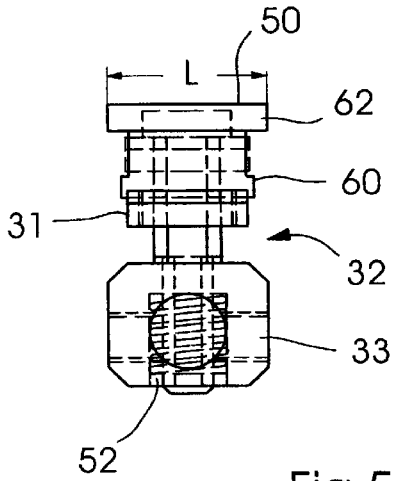
FIG. 5 shows an end view of the bearer wipe holder of the present invention.
Figure 6:
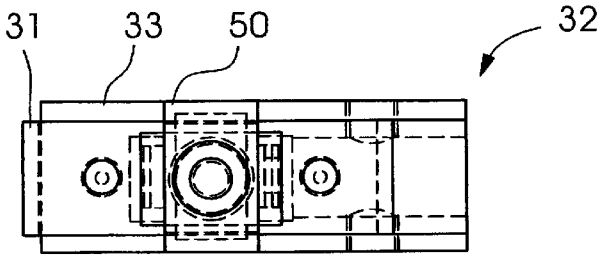
FIG. 6 shows an top view of the bearer wipe holder of the present invention;an FIG. 7 shows a bearer wipe holder of the present invention with an inserted wipe.

FIGS. 5 and 6 show end and top views respectively of holder 32, with numbers similar to those identified in FIGS. 3 and 4.

It should be understood that the wipe holder 30 and wipe 20 shown in FIG. 1 are generally of similar construction to wipe holder 32 and wipe 22.

What is claimed is:

1. A bearer wipe holder comprising:

a base; and a fastener selectively movable with respect to the base, a wipe fitting between the base and the fastener, the fastener contacting the base through apertures in the wipe at a first location and a second separate location when the wipe is between the base and the fastener.

2. The bearer wipe holder as recited in claim 1 further comprising a rotatable bolt for connecting the fastener to the base.

3. The bearer wipe holder as recited in claim 2 wherein the bolt has a head section for contacting an outer surface of the fastener, the outer surface of the fastener being opposite an inner surface of the fastener facing the base.

4. The bearer wipe holder as recited in claim 3 wherein the bolt is spring-loaded so that the head section is forced against the outer surface.

5. The bearer wiper as recited in claim 2 wherein the bolt fits through an aperture in the fastener.

6. A bearer wipe holder comprising:

a base; and a fastener selectively movable with respect to the base, a wipe fitting between the base and the fastener, the fastener contacting the base through the wipe at a first location and a second separate location when the wipe is between the base and the fastener; and at least two pins, the base and the fastener being connected at the first and second locations through the at least two pins which pass through holes in the wipe.

7. The bearer wipe holder as recited in claim 6 wherein the at least two pins are fixed to the fastener, and the base has two holes for accepting the at least two pins.

8. The bearer wipe holder as recited in claim 6 further comprising a rotatable bolt for connecting the fastener to the base.

9. The bearer wipe holder as recited in claim 8 wherein the bolt has a head section for contacting an outer surface of the fastener, the outer surface of the fastener being opposite an inner surface of the fastener facing the base.

10. The bearer wipe holder as recited in claim 9 wherein the bolt is spring-loaded so that the head section is forced against the outer surface.

11. The bearer wipe holder as recited in claim 8 wherein the bolt fits through an aperture in the fastener.

12. The bearer wipe holder as recited in claim 6 further comprising a bolt, the bearer wipe including a third hole or slot for receiving the bolt.

13. The bearer wipe holder as recited in claim 6 wherein the bearer wipe is made of felt.

* * * * *